US007097448B2

(12) United States Patent
Chesney

(10) Patent No.: US 7,097,448 B2
(45) Date of Patent: Aug. 29, 2006

(54) VORTEX TYPE GAS LAMP

(76) Inventor: Peter Chesney, 802 N. Reese Pl., Burbank, CA (US) 91502

( * ) Notice: Subject to any disclaimer, the term of this patent is extended or adjusted under 35 U.S.C. 154(b) by 73 days.

(21) Appl. No.: 10/841,614

(22) Filed: May 7, 2004

(65) Prior Publication Data

US 2005/0250064 A1 Nov. 10, 2005

(51) Int. Cl.
*F23C 7/00* (2006.01)
*F23Q 2/32* (2006.01)

(52) U.S. Cl. ..... 431/353; 431/253; 362/171; 362/180

(58) Field of Classification Search ..... 362/171, 362/180, 320, 96, 278; 431/353, 253
See application file for complete search history.

(56) References Cited

U.S. PATENT DOCUMENTS 3,418,651 A * 12/1968 Jacobson ..... 340/321
3,808,802 A * 5/1974 Tanasawa ..... 60/755
4,124,353 A 11/1978 Prudhon et al.
5,055,031 A 10/1991 Werner
5,154,059 A 10/1992 Keller
5,674,066 A 10/1997 Hausermann et al.
5,738,508 A 4/1998 Dobbeling et al.
5,876,196 A * 3/1999 Knopfel et al. ..... 431/183
5,921,766 A 7/1999 Dobbeling et al.
6,098,406 A 8/2000 Bolis et al.
6,176,087 B1 1/2001 Snyder et al.
6,196,835 B1 3/2001 Gutmark et al.
6,261,088 B1 * 7/2001 Butler ..... 431/290
6,270,338 B1 8/2001 Eroglu et al.
6,513,329 B1 2/2003 Snyder et al.
6,733,279 B1 * 5/2004 Thigpen et al. ..... 431/253

* cited by examiner

*Primary Examiner*—Alfred Basichas
(74) *Attorney, Agent, or Firm*—Donald D. Mon

(57) ABSTRACT

A vortex type gas lamp comprising a base and an axially extending-transparent shield. Gas is supplied near the bottom end of the shield. The shield is formed of a plurality (preferably two) axial curved sections which overlap one another at their axial edges to form tangentially directed port. Combustion of the gas with atmospheric oxygen admitted through the ports results in an axial vortex of burning gas useful for illumination, decoration and heat.

7 Claims, 2 Drawing Sheets

VORTEX TYPE GAS LAMP

FIELD OF THE INVENTION

A gas lamp which utilizes combustible gas burned as a linear vortex to produce light along a substantial flame length for illumination, comfort, mood, decoration and large scale art.

BACKGROUND OF THE INVENTION

Combustion flames have historically been used for their radiant and convective heating effects, and for illumination. Hearth fires, campfires, and fire rings are classical examples. The combustion of wood, coal, natural gas and bottled gas is generally the source of the flame.

The shape of the flame is rarely of interest in most applications where warmth, mood and "coziness" are the principal objectives. The flame itself usually will be in a confined (but vented) region, and much of the heat from the reverse side of the flame will be re-radiated by surrounding surfaces. However, much of the light and some of the radiant heat will be dissipated or hidden from view. In addition, the height of the flame may be quite low, and its illumination effect will be minimized. Gas lamps are not usually tall enough to provide effective illumination. As a consequence, most gas lamps, lanterns, or "tiki torches" are mounted on poles or suspended from an overhanging support, which limits their placement.

This invention provides an attractive, surprisingly tall disciplined flame as a generally cylindrical vortex, providing an extended light source useful for decoration and for illumination and heating. It is a safe structure. The flame is inside a transparent shield which remains surprisingly cool to the touch. Furthermore the inside of the shield is kept clean by the flame and the air flow.

The lamp of this invention is very inexpensive. It comprises sections of curved plastic material that can even be folded neatly for storage or shipment, but which springs back to its curved shape. It is elegantly simple, does not require a blower to create the swirling flame, and needs no side support.

BRIEF DESCRIPTION OF THE INVENTION

A gas lamp according to this invention comprises a plurality of axially-extending curved channel-like sections that are mounted parallel to one another to form a shield. Each section has an axially extending edge that overlaps the wall of its neighbor so as to form ports between them which extend axially along the sections and open tangentially into the combustion region inside of their assembly (the shield).

At one end of the assembly of the sections, a gas orifice is disposed which faces axially into the chamber. It need not be a classical burner, because air is supplied through the ports. A simple orifice or a perforated plate will usually suffice As the flame burns and rises, air is drawn into the chamber through the ports with a tangential movement. This results in a rotary swirling motion of the gases in the chamber. As the flame rises, air is brought into the chamber along the axis to feed the uncombusted material, thereby generating a flame that extends for a considerable axial length. It is this extended flame that is the objective of this invention.

The above and other features of this invention will be fully understood from the following detailed description and the accompanying drawings, in which:

DETAILED DESCRIPTION OF THE INVENTION

Figure 1:
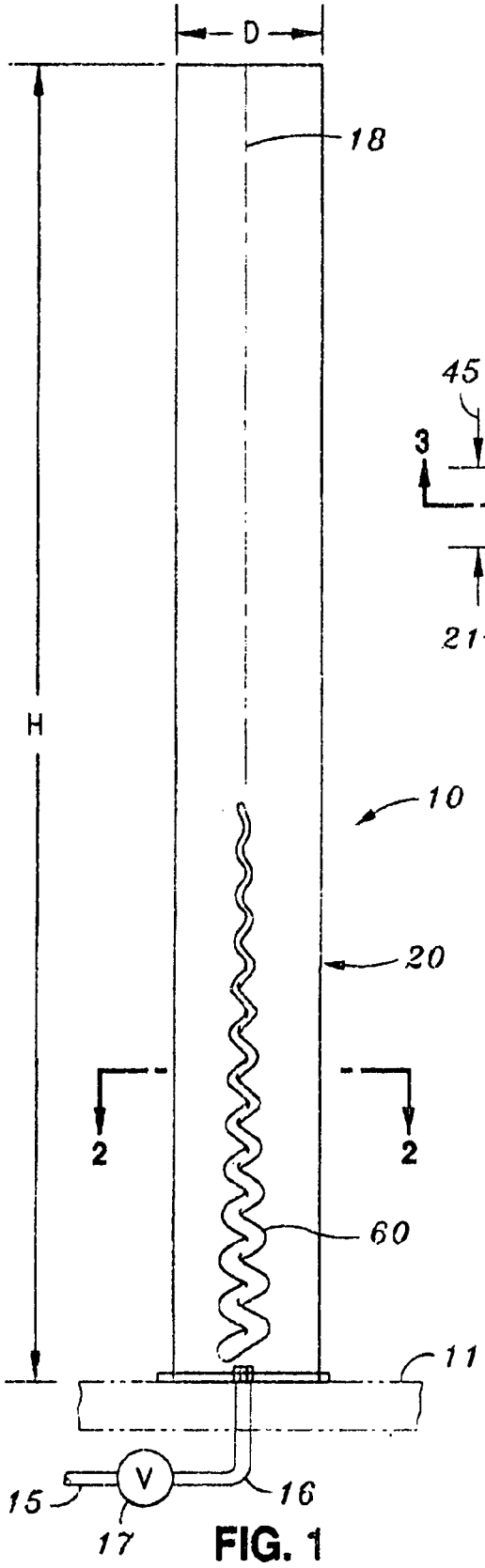
FIG. 1 is a side elevation showing the presently-preferred embodiment of a gas lamp according the invention.

The presently preferred embodiment of this invention is shown in FIG. 1. A gas lamp 10 rests on any suitable support 11 such as a table, fireplace, or wall. A source 15 of combustible gas is supplied under pressure through a conduit 16. A control valve 17 admits or prevents the admission of gas, and controls its rate of flow. A mixing burner or mixing nozzle is not needed. The air is supplied through the gaps in the wall structure.

The lamp is shown in an upright position, with its central axis 18 vertically oriented. Exact upright orientation is not necessary. It may be slanted downwardly, up to about 45 degrees from the vertical. Beyond that, the advantages of improved convection are lost, and the lamp is not as reliable.

This lamp is characterized by its elegant simplicity. It may be formed by as few as two parts, and usually will be. It is possible to use three or more, but there is no particular advantage in doing so, although it is within the scope of this invention.

The shield 20 of this invention is formed by two axially extending channel-like sections 21,22. These sections are preferably identical, and are arcuate in cross-section. They may be supported in grooves (not shown) in the support, or may be otherwise held in position together as preferred.

It is convenient for the sections to be identical. Then only one size and shape needs to be manufactured and kept in inventory. In the most convenient arrangement, both of them are axial sections of a cylinder.

For example, section 21 has a center 25, a curved body 26, and a pair of end edges 27,28. The ends are parallel to one another, and to axis 18. Section 21 has a wall thickness 29, which is quite thin, an outer wall 30 and an inner wall 31.

Similarly, section 22 has a center 35, a curved body 36, and a pair of end edges 37,38. The ends are parallel to one another and to axis 18. Section 22 has a wall thickness 39, which is quite thin, an outer wall 40 and an inner wall 41.

Figure 2:
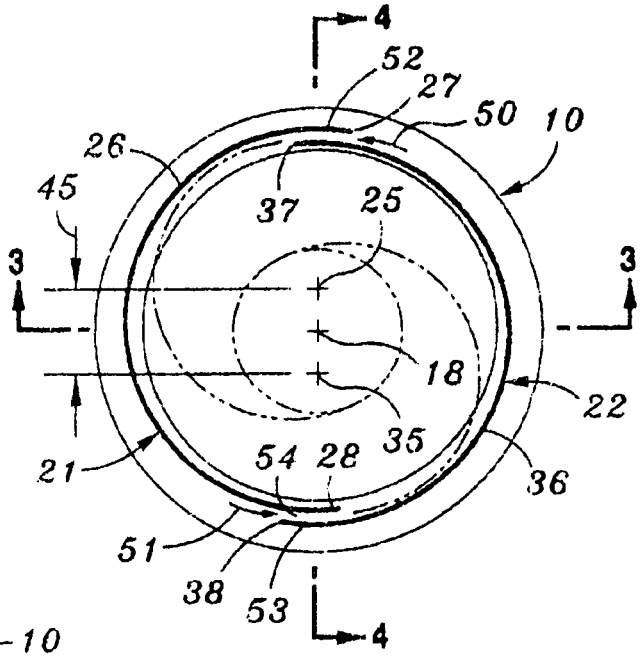
FIG. 2 is a cross-section taken at line 2—2 in FIG. 1.
Figure 3:
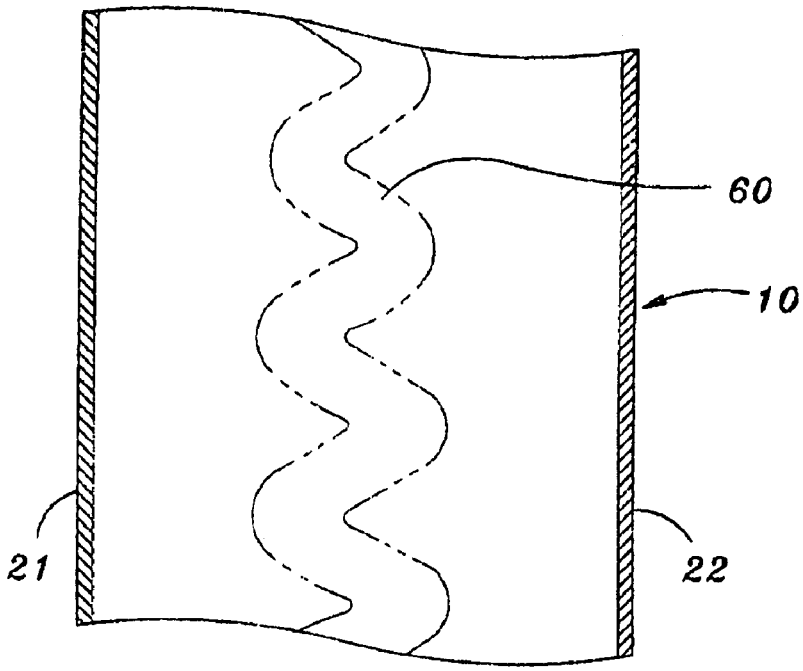
FIG. 3 is a cross-section taken at line 3—3 in FIG. 2.
Figure 4:
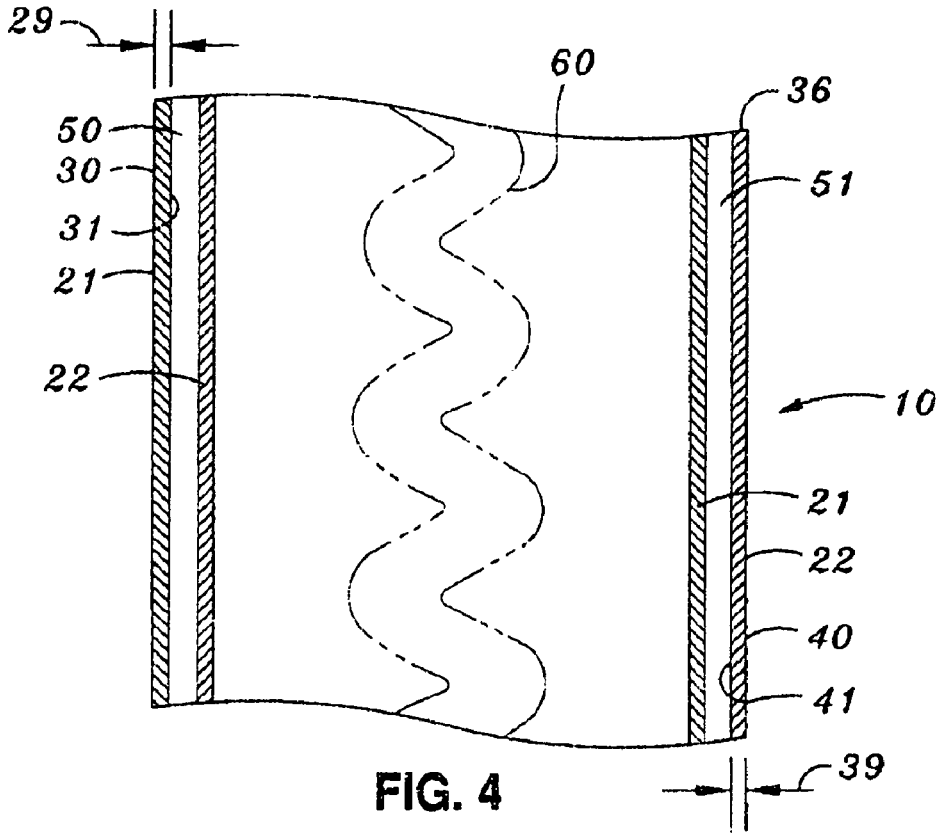
FIG. 4 is a cross-section taken at line 4—4 in FIG. 2.

Importantly to this invention, as shown in FIG. 2, the respective ends of both sections, for example end edges 27 and 28, extend onto the same side of a diameter 42 that is to say, the arcuate dimension of each of the sections exceeds 180 degrees.

Again as will be seen in FIG. 2, centers 25 and 35 of sections 21 and 22 are offset from one another by a dimension 45. This offset dimension is approximately aligned with the mid portions of the sections.

As a consequence, two axially-extending air ports 50,51 are formed between areas of the two sections. In FIG. 2, notice that end edges 27 and 38 of sections 21 and 22 have passed over one another and that a region 52 of sections 21 and region 53 of section 22 face one another to form the gap-like port. A similar port 54 is formed at the other end edges. It will be observed that the edge section which is outermost at one port is the inner-most at the other.

This arrangement establishes two ports for air which are tangentially directed in the same rotational sense. The heat of burning gases rising in the structure will draw air into the combustion chamber in a way that will create a rotationally swirling flow pattern.

Especially notice that the air is continuously supplied along the length of the structure, so the combustion occurs along the entire path. Importantly, the incoming air flows along the inner walls and cools them. Further, it tends to keep them clean, and avoids the formation of smoke which would reduce the clarity of the structure and visibility of the flame.

Should more than two sections be desired, perhaps because of a very large diameter, the overlaps at the edges will be similar in function, but more numerous than two.

The preferred material is transparent, stiffly flexible, and self-shape retaining, so that when released after bending it returns to its original shape. A polycarbonate is preferred, although other substantially non-combustible plastics may be used instead. This material in its bent form is self-shape restoring. It can be folded for storage and will return to its curved shape when released. Although this shield will contain a flame, the flame will not directly contact the shield. Still it is preferred to use one which will not combust should flame impinge directly on it for some reason.

A wall thickness of about 0.030 inches will generally suffice for a shield as tall as 6 feet, with diameters ranging up to about 12 inches. Thicker walled material may be required for taller or larger diameter shields. Thinner material may be used for shorter heights and smaller diameters.

Suitable dimensions for a useful gas lamp according to this invention are as follows:

For a 30 inch lamp radius about 1.5 inches. For a 6 foot tall lamp, radius about 12 inches.

The height of the structure will be taller than the flame so the flame is entirely contained. The width of the ports is adjustable and selectible. A minor amount of adjustment will determine the proper width.

Although there is a wide range of dimensions, including height diameter, and ports, there appears to be a relationship which presents a particularly well-organized flame with a maximized flame height. This ratio is: height/radius is about 6:1.

The material will be transparent or translucent. It usually will be clear and colorless, but may be tinted if desired. Plastic material is to be preferred, although glass or other materials having similar light transmission properties may be used, although they may not have the desirable flexibility.

There results an attractive, elegantly simple and safe gas lamp, made of inexpensive material, which produces maximum light from the amount of fuel burned. The flame 60 is illustrated in the drawings in a "corkscrew" manner to emphasize the swirling motion. However, as viewed it will appear nearly cylindrical.

This invention is not to be limited by the embodiment shown in the drawings and described in the description, which is given by way of example and not of limitation, but only in accordance with the scope of the appended claims.

I claim:

1. A vortex type gas lamp for producing an upwardly-directed vortex flame of combustible gas inside a surrounding and confined boundary of rotating body of air, there existing during operation an interface located between said body of air devoid of said gas and a central region of said gas bounded by said interface inside of which substantially all of the combustion of said gas occurs, said lamp having a central axis and comprising:

a base having a base surface extending laterally from said central axis, with provision to supply combustible gas without air at and nearly adjacent to said central axis;

a shield comprising a first and a second axially-extending section, each said section having an upper end and a lower end, each said section being structurally attached to said base at its lower end in fluid-sealing relationship therewith, said sections being substantially identical and transparent to light, each constituting an impermeable wall having an arcuate inner surface and an arcuate outer surface, each said section having a first and a second edge extending axially from end to end;

said first and second walls alternately overlapping one another and adjacent to their edges spaced from one another so as to form tangentially-directed ports, thereby forming an axially-extending chamber open at its side only through said ports;

said sections being so disposed and arranged that at the base they surround the entry of the combustible gas;

said gas receiving air for combustion only through said ports, whereby combustion of the gas results in a flame spaced from said inner surfaces, with said peripheral body of air devoid of gas entering through said ports.

2. A vortex type gas lamp according to claim 1 in which said cross-section is defined by an arc having a radius and a center of curvature, said centers being spaced apart from one another so that their respective edges overlap to form said ports, and thereby provide for said inlet flow of air tangentially into said chamber.

3. A vortex type gas lamp according to claim 2 in which the arcuate extent of each segment exceeds 180 degrees.

4. A vortex type gas lamp according to claim 1 in which said shield is made of an organic plastic material.

5. A vortex type gas lamp according to claim 4 in which said material with thickness as used is stiffly flexible and inherently shape-restoring so as to be foldable for storage, and which returns to its curved shape when released.

6. A vortex type gas lamp according to claim 4 in which said lower ends of said sections are removably seated in arcuate grooves formed in said base surface, said grooves having curvature respective to the curvature of the sections when assembled as described.

7. A vortex type gas lamp according to claim 1 in which said shield comprises more than two segments, all identical, which overlap at their axially-extending edges as defined.

* * * * *